US010982839B1

(12) United States Patent
Yang et al.

(10) Patent No.: US 10,982,839 B1
(45) Date of Patent: Apr. 20, 2021

(54) STRIP LIGHT

(71) Applicant: LONGHORN INTELLIGENT TECH CO., LTD, Shenzhen (CN)

(72) Inventors: Haitao Yang, Shenzhen (CN); Min Liu, Shenzhen (CN); Xingwei Huang, Shenzhen (CN); Lei Li, Shenzhen (CN); Lin Yang, Shenzhen (CN)

( * ) Notice: Subject to any disclaimer, the term of this patent is extended or adjusted under 35 U.S.C. 154(b) by 0 days.

(21) Appl. No.: 16/928,639

(22) Filed: Jul. 14, 2020

(51) Int. Cl.

| | |
|---|---|
| ***F21V 19/00*** | (2006.01) |
| ***F21V 3/02*** | (2006.01) |
| ***F21V 15/015*** | (2006.01) |
| ***F21Y 103/10*** | (2016.01) |
| ***F21Y 115/10*** | (2016.01) |

(52) U.S. Cl.
CPC ..... *F21V 19/0035* (2013.01); *F21V 3/02* (2013.01); *F21V 15/015* (2013.01); *F21Y 2103/10* (2016.08); *F21Y 2115/10* (2016.08)

(58) Field of Classification Search
CPC ..... F21V 19/0035; F21V 3/02; F21V 15/015; F21V 5/043; F21V 21/005; F21S 4/20; F21S 4/28; F21Y 2103/10; F21Y 2115/10
See application file for complete search history.

(56) References Cited

U.S. PATENT DOCUMENTS

| | | | | |
|---|---|---|---|---|
| 8,579,463 | B2 | 11/2013 | Clough | |
| 9,127,874 | B2 * | 9/2015 | Ye | F21V 21/025 |
| 9,228,708 | B2 | 1/2016 | Dings et al. | |
| 9,638,398 | B2 | 5/2017 | Nicolai et al. | |
| 9,863,628 | B2 | 1/2018 | Reingruber et al. | |
| 9,897,265 | B2 | 2/2018 | Xiong et al. | |
| 10,066,812 | B1 * | 9/2018 | Esteves | F16B 7/20 |
| 10,215,365 | B2 | 2/2019 | Yu | |
| 10,330,298 | B2 | 6/2019 | Wang et al. | |
| 2014/0009926 | A1 * | 1/2014 | Simon | F21V 17/12 362/222 |
| 2020/0088395 | A1 * | 3/2020 | Shi | F21S 8/03 |

* cited by examiner

*Primary Examiner* — Peggy A Neils
(74) *Attorney, Agent, or Firm* — Clement Cheng

(57) ABSTRACT

A strip light has an elongated light module that mounts to a mounting frame with a lamp body bracket. The lamp body bracket is elongated and has a front mounting frame panel, a rear mounting frame panel, a right mounting frame panel, and a left mounting frame panel extending from a lamp body bracket base panel of the lamp body bracket. A first rotating shaft lock is mounted to the lamp body bracket base panel on a first axis of rotation. A second rotating shaft lock is mounted to the lamp body bracket base panel on second axis of rotation. The light module is secured to the lamp body bracket by a pair of rotating locks. An LED light board has LED chips. A hook groove system with a first groove and a second groove is mounted or formed underneath the LED light board.

15 Claims, 9 Drawing Sheets

STRIP LIGHT

FIELD OF THE INVENTION

The present invention is in the field of strip lights.

DISCUSSION OF RELATED ART

A variety of different strip light systems provide linear lighting for shops, factories and the like. Some of these strip light systems have interconnections between them for connection of lighting parts. For example, in U.S. Pat. No. 8,579,463 Modular Lighting System by inventor Christian James Clough published Nov. 12, 2013 the abstract discloses, "An LED tube is provided for providing general illumination. The LED tube includes a tubular housing having a clear shield and a heat sink opposite the clear shield. A strip including LED lights, circuitry, and electrical hubs are positioned on the backside of the heat sink under the shield. The housing also includes first and second ends that include portions of a quarter turn locking system to allow multiple housings to be attached to one another for a longer string of lighting. A power source for powering the LED lights, and an end cap may also be attached to the first and second ends of the housing by the quarter turn locking system. The housing or housings may be connected to a wall or the like by the use of one or more clip mounts."

For example, in U.S. Pat. No. 9,228,708 Linear LED System by inventor Franciscus Cornelius Dings et al. published Jan. 5, 2016 the abstract discloses, "A linear LED system including a plurality of line light modules, each line light module comprising an extruded light module housing profile that extends along an axis and that has a profile wall defining an inner profile contour and an outer profile contour and of which a cross sectional view along a plane that is perpendicular to the axis is closed, wherein the profile wall in the cross sectional view defines a LED chamber. At least one LED-strip including a plurality of LEDs is accommodated in an associated LED chamber. The system further includes a plurality of interface modules, each interface module that connect the housing profiles and that an inner space in which at least one power supply module is accommodated so that the power supply module and any other electronic controller equipment is not, or at least to a lesser extend exposed to heat dissipated by the LEDs."

For example, in U.S. Pat. No. 9,638,398 Lighting devices by inventor Richard Nicolai et al. published May 2, 2017 the abstract discloses, "A lighting device includes a cover portion configured to have a hinged connection for mounting on a housing. The cover portion includes a light emitting diode (LED) and a mixing chamber having a reflective internal surface for receiving light from the LED. A phosphorescent lens is disposed opposite the LED and is configured to reflect light from the LED back to the mixing chamber and to emanate absorbed light from the lens to a surrounding region outside of the mixing chamber. An LED driver circuit is configured to power the LED, the LED driver circuit being electrically connected to a power source. Other embodiments are also disclosed."

For example, in U.S. Pat. No. 9,863,628 Semiconductor Retrofit Lamp Having Connecting Elements Arranged On Two Sides by inventor Fabian Reingruber et al. published Jan. 9, 2018 the abstract discloses," Various embodiments may relate to a semiconductor retrofit bulb, in particular a retrofit festoon bulb, having connecting elements that are arranged on two sides. The semiconductor retrofit bulb may include at least a tubular cooling body having at least one outer face support surface, wherein there is arranged on the support surface at least one semiconductor light source, in particular a light diode, a driver housing that is introduced into a hollow space of the tubular cooling body. At least one flow channel is provided between the driver housing and the cooling body."

For example, in U.S. Pat. No. 9,897,265 LED Tube Lamp Having LED Light Strip by inventor Aiming Xiong et al. published Feb. 20, 2018 the abstract discloses, "An LED tube lamp, comprising a lamp tube, which includes a light transmissive portion, a reinforcing portion and an end cap; an LED module, which includes an LED light source and an LED light strip; and a power supply module, which includes a set of N electronic components operably interconnected to drive the LED light source, wherein: the light transmissive portion is fixedly connected to the reinforcing portion; the reinforcing portion includes a platform and a bracing structure; the bracing structure is fixedly connected to the platform and holds the platform in place; the LED light source is thermally and electrically connected to the LED light strip, which is in turn thermally connected to the reinforcing portion; and the end cap is attached to an end of the lamp tube."

For example, in U.S. Pat. No. 10,215,365 Lighting Device And Method For Manufacturing The Same by inventor Byeong Hyeon Yu et al. published Feb. 26, 2019 the abstract discloses, "A lighting device in which a heat sink and a cover are formed by co-extrusion and a manufacturing method for the same are provided. The heat sink and the cover may be co-extruded. A shape control portion may be formed at the heat sink to control a shape of a seating portion to seat a circuit substrate during extrusion of the heat sink. In addition, a light characteristic control portion may be provided between a light emitting diode (LED) and the cover to control characteristic of light generated from the LED."

For example, in U.S. Pat. No. 10,330,298 Lighting System With Customized Intensity Having A Plurality Of LED Strips And Controller And Drive Mounted To Each Strip by inventor Jun Wang et al. published Jun. 25, 2019 the abstract discloses, "A light fixture suitable for use with fluorescent light bulbs as a fluorescent light fixture includes a frame, a plurality of LED mounting strips that are removably coupled to the frame, a plurality of LEDs that are disposed on each of the plurality of LED mounting strips, and a plurality of drivers. Each of the plurality of drivers is disposed on one of the plurality of LED mounting strips and electrically coupled to the plurality of LEDs disposed on each of the plurality of LED mounting strips."

SUMMARY OF THE INVENTION

A strip light has a light module with a lens that has a light permeable portion. The light module is elongated. A mounting frame has a lamp body bracket receiving the light module. The lamp body bracket is elongated and has a front mounting frame panel, a rear mounting frame panel, a right mounting frame panel, and a left mounting frame panel extending from a lamp body bracket base panel of the lamp body bracket. A first rotating shaft lock is mounted to the lamp body bracket base panel with a first axis of rotation. A second rotating shaft lock is mounted to the lamp body bracket base panel with a second axis of rotation. The light module is secured to the lamp body bracket by a pair of rotating locks, which include the first rotating shaft lock and the second rotating shaft lock. An LED light board has LED chips mounted to the LED light board. A hook groove system is mounted or formed underneath the LED light board. The hook groove system includes a first groove and a second groove preferably facing each other.

A first tab extension is mounted on the first rotating shaft lock. The first tab extension rotates to engage the first groove. A second tab extension is mounted on the first rotating shaft lock. The second tab extension rotates to engage the second groove. The lens has an opaque portion next to the light permeable portion. The strip light preferably optionally includes a connection adapter for chaining strip lights together into one large continuous strip light. The connection adapter provides mechanical and structural connection in a rigid format. The connection adapter has a connection adapter first side and a connection adapter second side which can be made by aluminum extrusion. Preferably, the connection adapter adapts to the lamp body bracket at a first end of the lamp body bracket, or at a second end of the lamp body bracket.

The connection adapter has two pairs of vertical bolts, namely a pair of first side vertical bolts, and a pair of second side vertical bolts, wherein the two pairs of vertical bolts extend through the connection adapter. The connection adapter has two pairs of side set screws. The two pairs of side set screws are mounted in the connection adapter first side.

The strip light may have an adapter first flange and an adapter second flange. The adapter first flange extends from the connection adapter first side, and the adapter second flange extends from the connection adapter second side. The a front overhang can be formed on the front mounting frame panel and a rear overhang can be formed on the rear mounting frame panel. The first adapter flange engages the front overhang and the adapter second flange engages the rear overhang when the two pairs of vertical bolts are engaged.

The first rotating shaft lock has a first lever handle and the second rotating shaft lock has a second lever handle. The first lever handle extends from a first shaft lock slot, and the second lever handle extends from a second shaft lock slot. The first shaft lock slot is located to the right of the second shaft lock slot. The second shaft lock slot is located to the left of the first shaft lock slot. The first shaft lock slot is a right shaft lock slot, and the second shaft lock slot is a left shaft lock slot. The first rotating shaft lock is mounted to a first rotating flange joint, and the second rotating shaft lock is mounted to a second rotating flange joint.

The following callout list of elements can be a useful guide in referencing the element numbers the drawings.

20 Light Module
21 Upper Right End Cap
22 Light Permeable Portion
23 Opaque Portion
24 Right End
25 Left End
26 Right Connector
27 Left Connector
28 Upper Left Endcap
29 Lamp Body Base Panel
30 Mounting Frame
31 Front Mounting Frame Panel
32 Rear Mounting Frame Panel
33 Right Mounting Frame Panel
34 Left Mounting Frame Panel
35 Lamp Body Bracket
36 Wiring Cover
37 Wiring Cover Tab
38 Rear Wing
39 Front Wing
40 Electronics
41 Led Light Board
42 Led Chip
43 Power Supply
44 First Rotating Shaft Lock
45 Right Shaft Lock Slot
46 Left Shaft Lock Slot
47 Second Rotating Shaft Lock
48 LED strip connection
49 Strip Edge
50 Hook Groove System
51 First Groove
52 Second Groove
53 First Tab Extension
54 Second Tab Extension
55 Post
56 Rotating Flange Joint
57 Lever Handle
58 Tab Extension Mounting
59 Post Bolt
61 First Indent
62 Second Indent
63 Lever Handle Reinforcement Stamp
64 Post Upper End
65 Post Key
70 Connection Adapter
71 Adapter First Side
72 Adapter Second Side
73 First Side Vertical Bolts
74 Second Side Vertical Bolts
75 Adapter First Flange
76 Adapter Second Flange
77 First Lower Channel
78 Second Lower Channel
79 Side Threaded Nut Columns
81 Front Overhang
82 Rear Overhang
83 Side Set Screw
84 Lower Sidewall Channel
85 Upper Sidewall Channel

DETAILED DESCRIPTION OF THE PREFERRED EMBODIMENT

Figure 1:
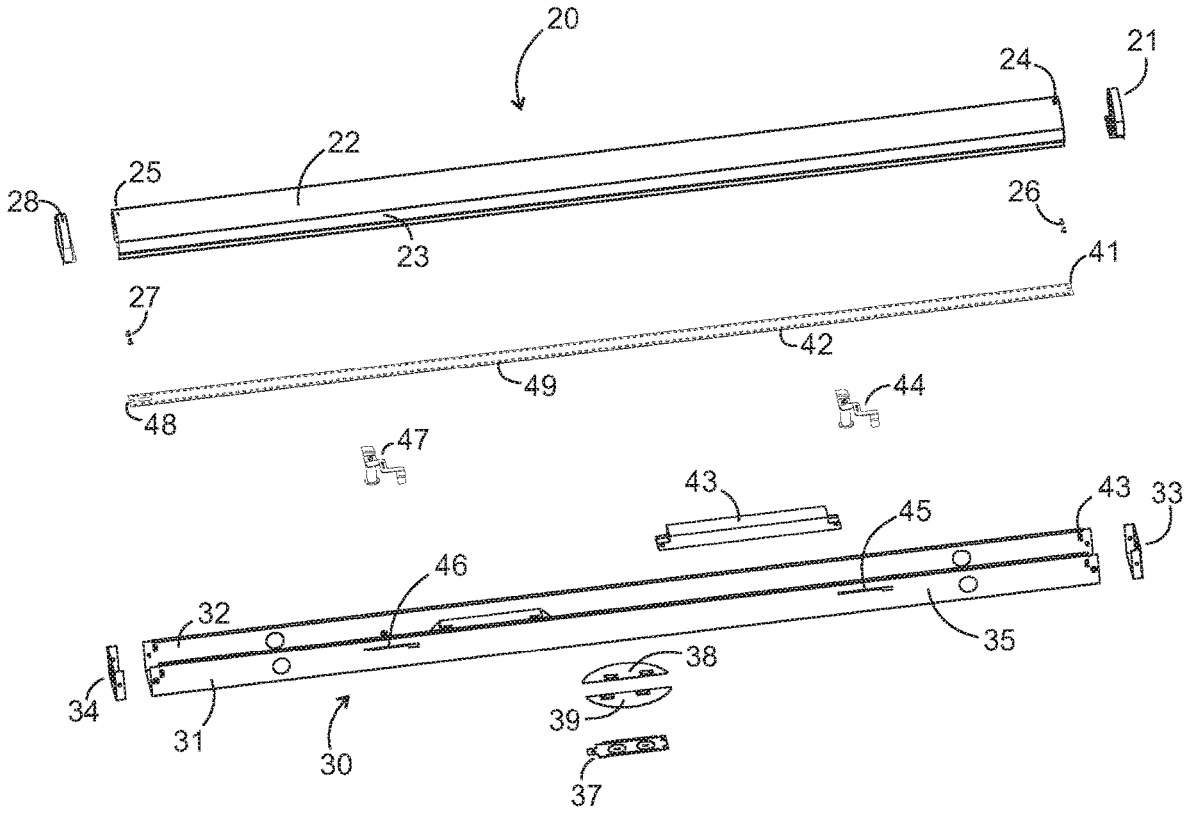
FIG. 1 is an exploded view of the present invention.

As seen in FIG. 1, the light module 20 has a light permeable portion 22, and an opaque portion 23. The light module 20 can be formed as an extrusion receiving an upper right endcap 21 at a right end 24, and receiving an upper left endcap 28 at a left end 25. A right connector 26 can secure the upper right endcap to the right end, and a left connector 27 can secure the upper left endcap to the left end.

The light module 20 is mounted to the mounting frame 30. The mounting frame generally includes a 35 lamp body bracket having four extending sidewalls formed as panels which include a front mounting frame panel 31, a rear mounting frame panel 32, a right mounting frame panel 33, and a left mounting frame panel 34 extending from a 29 lamp body base panel.

The wiring cover 36 mounts to an electrical box to which the apparatus is designed to connect to. The wiring cover 36 includes a wiring cover tab 37 that engages the electrical box. If the electrical box is circular, a front wing 39 and a rear wing 38 can adapt the wiring cover 36 to form a round wiring cover.

Within the light module 20 electronics 40 power the lighting system. The electronics 40 include an LED light board 41 which has a plurality of LED chips 42. A power supply 43 powers the light board 41. The light board 41 is elongated in the shape of a strip and when mounted with LED chips 42 comprises an LED strip. The LED strip has a strip edge 49 with an LED strip connection 48 that optionally connects from one LED strip to another adjacent LED strip. The strip edge 49 is elongated.

The light module 20 is secured to the lamp body bracket 35 by a pair of rotating locks, including a first rotating shaft lock 44 and a second rotating shaft lock 47. The first rotating shaft lock 44 can engage a hook groove system 50 which can be accessed at a right shaft lock slot 45 and the second rotating shaft lock 47 can engage a hook groove system which can be accessed at a left shaft lock slot 46.

Figure 2:
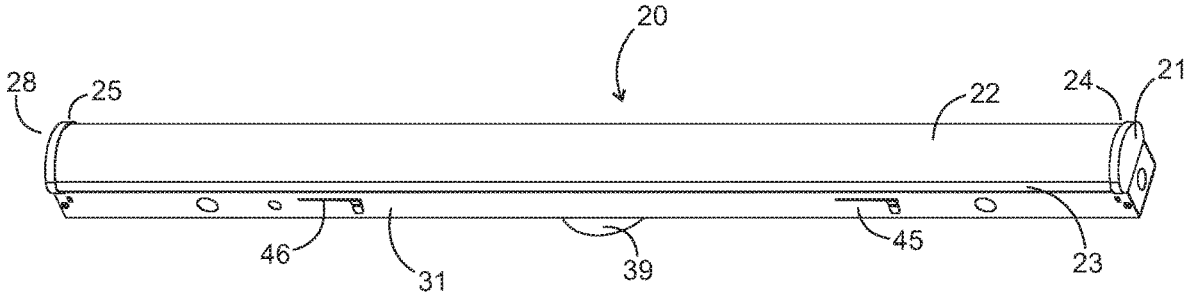
FIG. 2 is an outside view of the present invention.

As seen in FIG. 2, the lamp body has an upper right end cap 21 connected at the right end 24 and an upper left endcap 28 connected at the left end 25. The light permeable portion 22 is primarily visible, with a strip of an opaque portion 23 between the light permeable portion and the lamp body bracket. The front wing 39 can be visible and peeking out from underneath the lamp body bracket. The front mounting frame panel 31 is formed between the front wing 39, and the opaque portion 23. The right shaft lock slot 45 and the left shaft lock slot 46 are preferably mounted facing a user to allow easy access.

Figure 3:
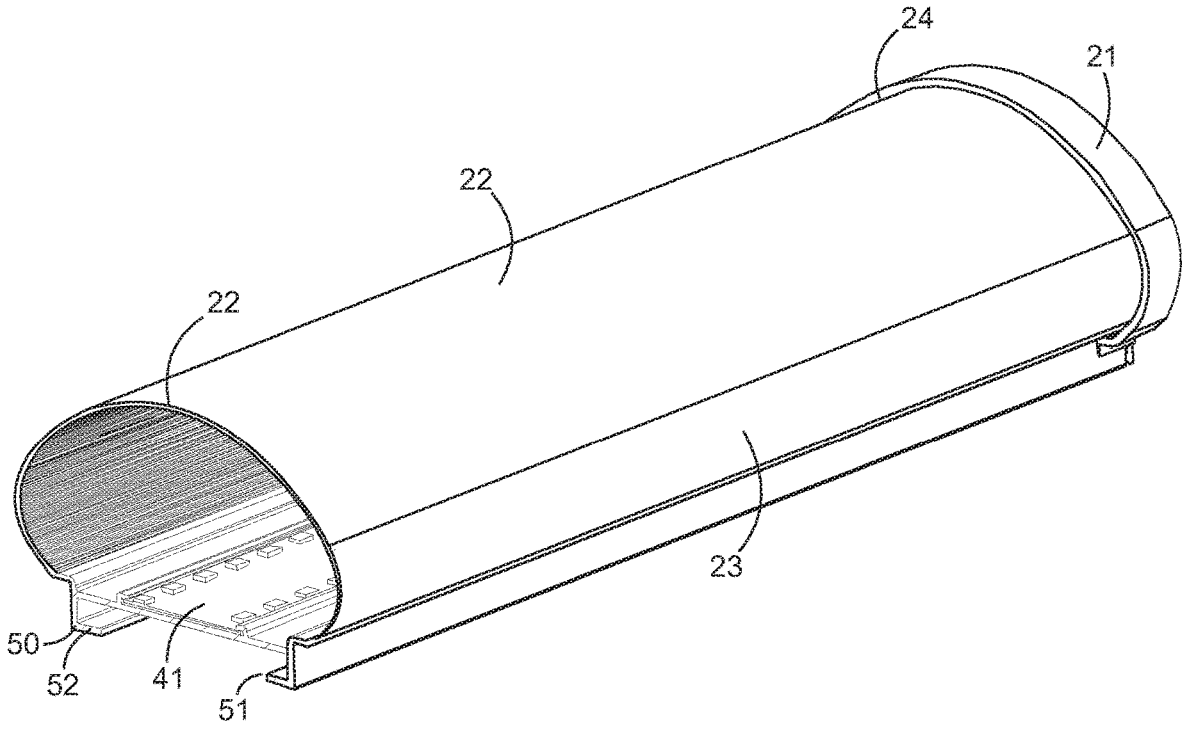
FIG. 3 is a cross-section view of the present invention.

As seen in FIG. 3, the upper right end cap 21 is connected to the right end 24 which seals the light permeable portion 22 and the opaque portion 23 to the LED light board 41. Adjacent to the LED light board 41 is a hook groove system 50 which includes a first groove 51 and a second groove 52. The pair of grooves face each other and the first groove 51 faces the second groove 52 underneath the light board 41. The pair of grooves can be extruded from an aluminum extrusion.

Figure 4:
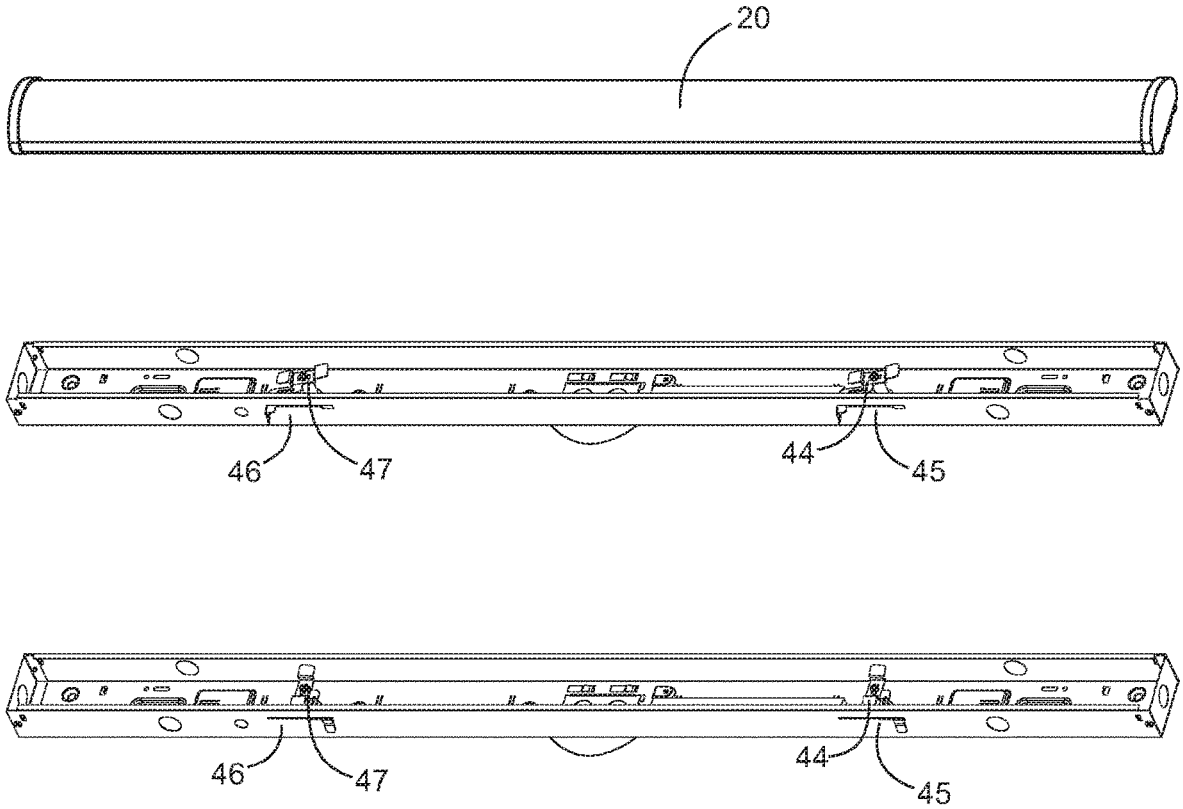
FIG. 4 is an assembly view of the present invention.

As seen in FIG. 4, the light module 20 can be locked to a first rotating shaft lock 44 which is a right shaft lock and a second rotating shaft lock 47 can be accessed at the left shaft lock slot 46.

Figure 5:
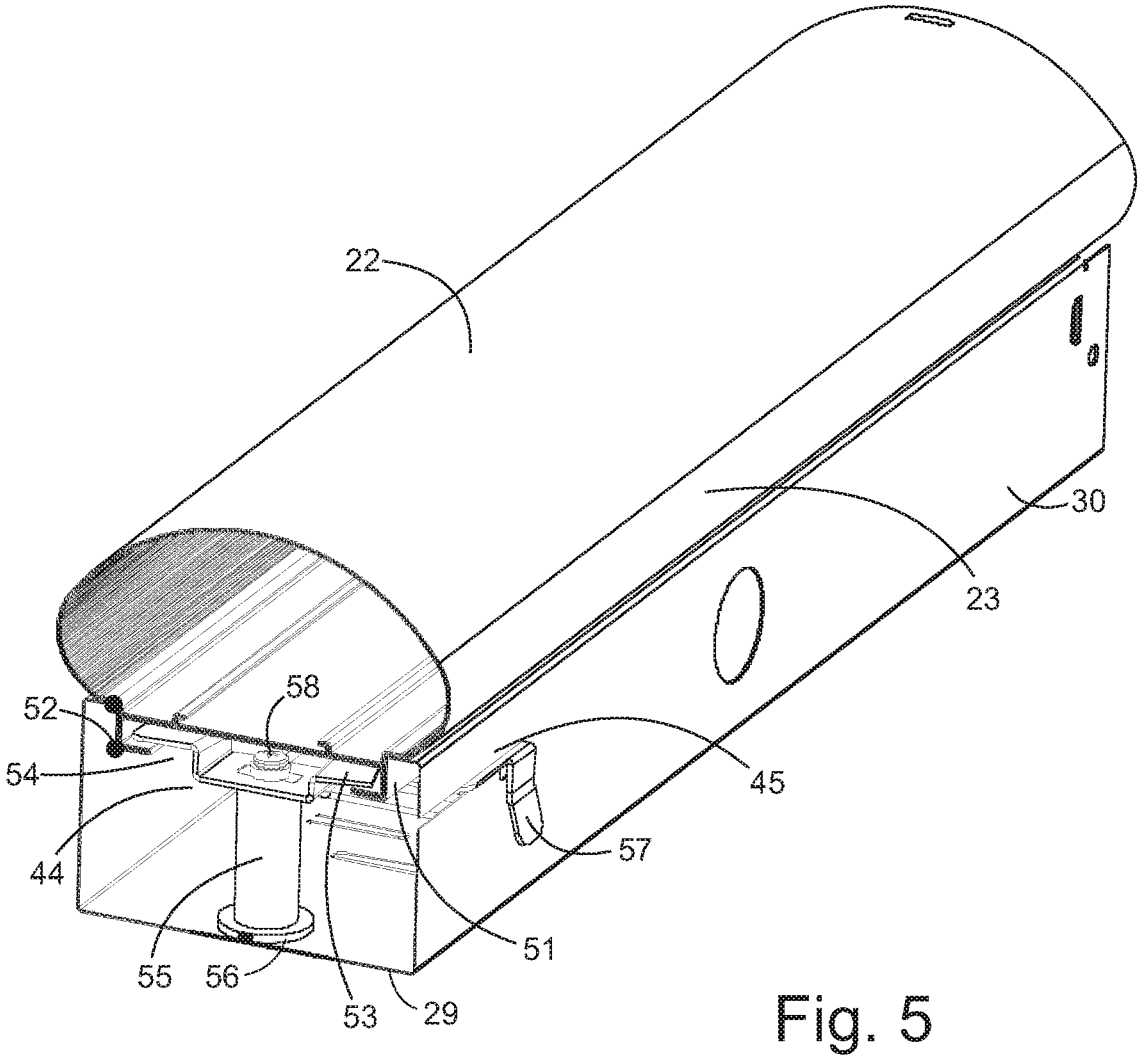
FIG. 5 is a cross-section view of the present invention.

As seen in FIG. 5, the light permeable portion 22 is above the opaque portion 23, which in turn is retained by the first rotating shaft lock 44 which engages the right shaft lock slot 45. The first tab extension 53 rotates to engage the first groove 51 and the second tab extension 54 rotates to engage the second groove 52. The post 55 is mounted to the mounting frame 30 at a rotating flanged joint 56. The rotating flange joint 56 can be a circlip or a rivet connection. The lever handle 57 extends from the right shaft lock slot 45. The first lever handle can extend from the right shaft lock slot 45, and the second lever handle can extend from the left shaft lock slot. The tab extension mounting 58 secures the first groove 51 and the second groove 52 to the post 55.

Figure 6:
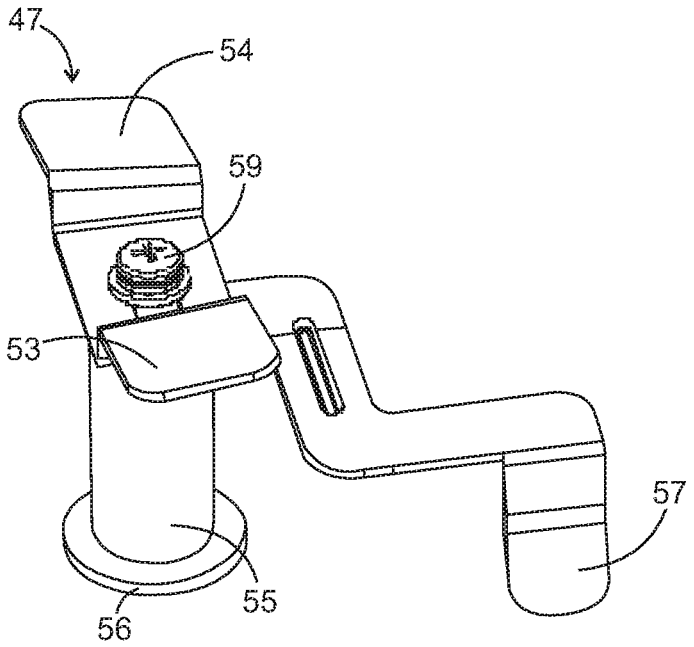
FIG. 6 is a diagram showing exploded view assembly of the pair of rotating shaft locks.
Figure 6:
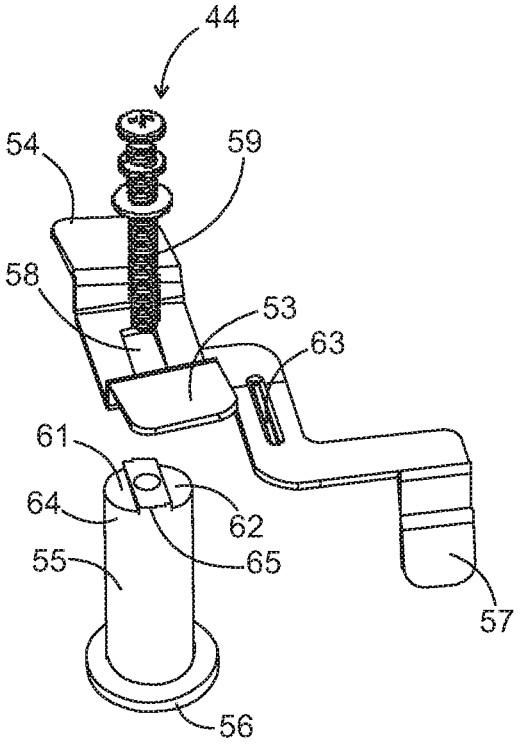

As seen in FIG. 6, the first rotating shaft lock 44 and the second rotating shaft lock 47 both have a first tab extension 53 and a second tab extension 54 mounted on a post 55. The rotating flange joint 56 rotates when a lever handle 57 is rotated. The lever handle 57 extends from the right shaft lock slot 45 or the left shaft lock slot 46. The tab extension mounting 58 provides a connection between the post bolt 59 and the post upper end 64. The post upper end 64 has a first indent 61 and a second indent 62. The first indent 61 and the second indent 62 form a post key 55 between them. The post key 55 extends into the tab extension mounting 58's formed as a slot. A lever handle reinforcement stamp 63 can be an indented portion of the lever handle to provide additional rigidity when rotating the lever handle.

Figure 7:
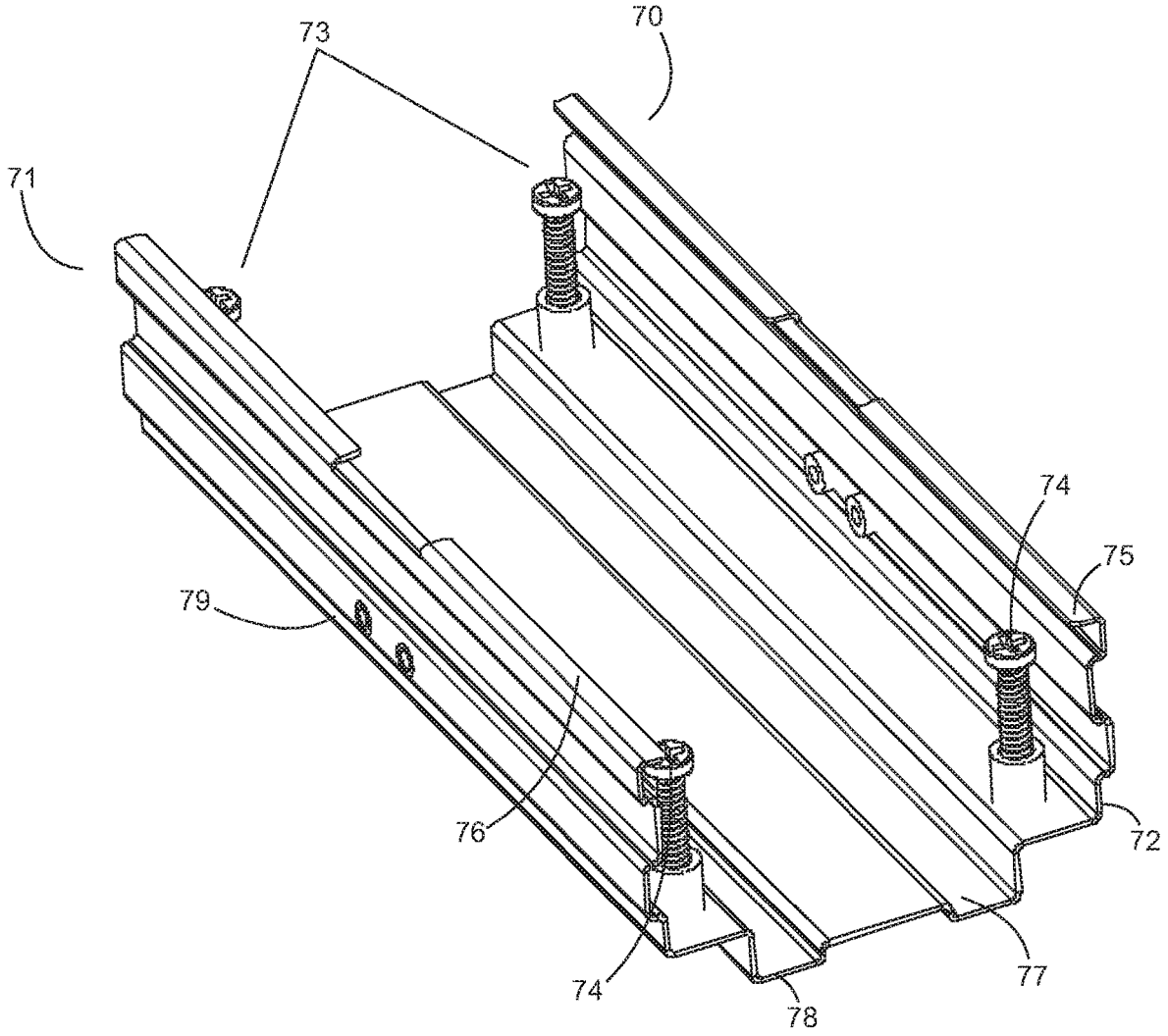
FIG. 7 is a diagram showing the connection adapter.
Figure 8:
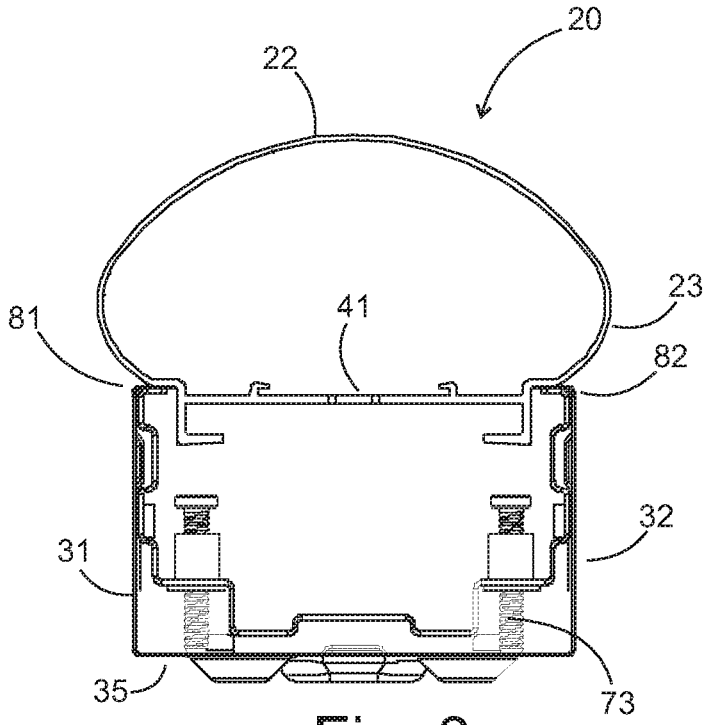
FIG. 8 is a cross-section view of the lamp body bracket.
Figure 9:
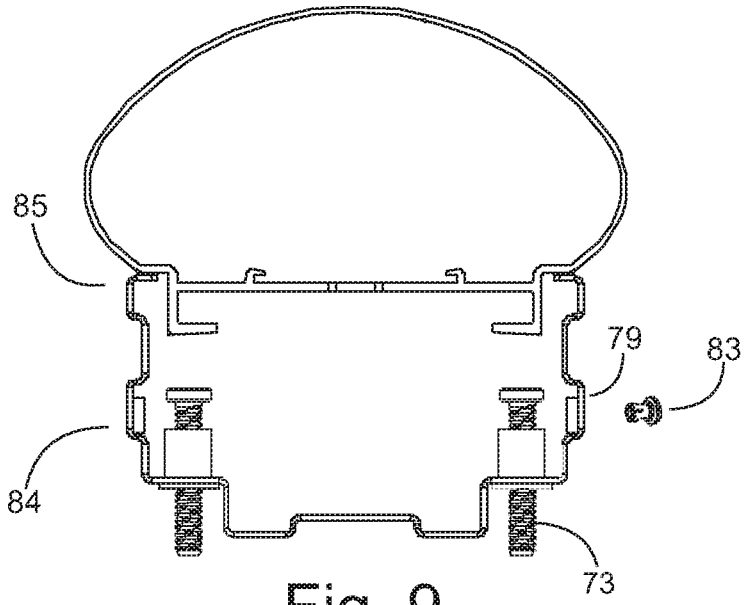
FIG. 9 is a second cross-section view of the lamp body bracket.

As seen in FIG. 7, a connection adapter 70 can bridge two adjacent linear light units at a left end 25, or a right end 24. The connection adapter 70 has an adapter first side 71 and an adapter second side 72. The first side vertical bolts 73 are mounted on the adapter first side 71 and the second side vertical bolts 74 are mounted on the adapter second side 72. The four vertical bolts are threaded and act as stands for pushing the surface adjacent to them. The connection adapter 70 has a pair of sidewalls. Each of the pair of sidewalls has an adapter first flange 75 above an adapter second flange 76. The lower wall of the connection adapter 70 includes a first lower channel 77 and a second lower channel 78. Each of the pair of sidewalls has a pair of side threaded nut columns 79 which receive set screws being four in total. The set screws engage the lamp body bracket 35.

As seen in FIGS. 8-11, the light module 20 with the light permeable portion 22 facing away from the opaque portion 23 has a connection adapter 70 mounted between the front mounting frame panel 31 and the rear mounting frame panel 32. The lamp body bracket 35 retains the connection adapter 70. The first side vertical bolts 73 engage the lamp body bracket 35 which lodges the connection adapter 70 to the lamp body bracket 35. The lamp body bracket 35 has a front overhang 81 and a rear overhang 82. The adapter first flange 75 engages the front overhang 81, and the adapter second flange engages the rear overhang 82. Additionally, the side threaded nut columns 79 receive side set screws 83 so that the side set screws 83 engage a side wall of the lamp body bracket 35 when the side set screws 83 are activated. The side set screws 83 are mounted on the lower sidewall channel 84. The lower sidewall channel 84 is located below the upper sidewall channel 85 on a side wall of the connection adapter 70.

Figure 10:
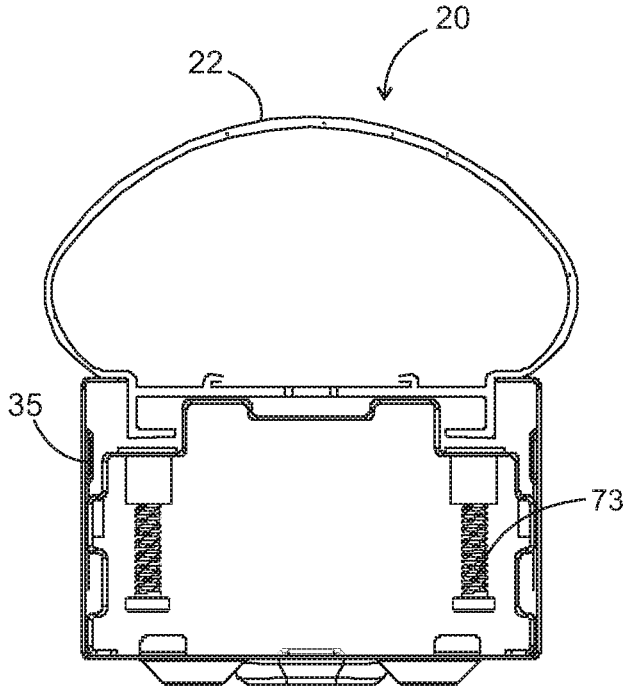
FIG. 10 is a cross-section view of the lamp body bracket with the connection adapter reversed.
Figure 11:
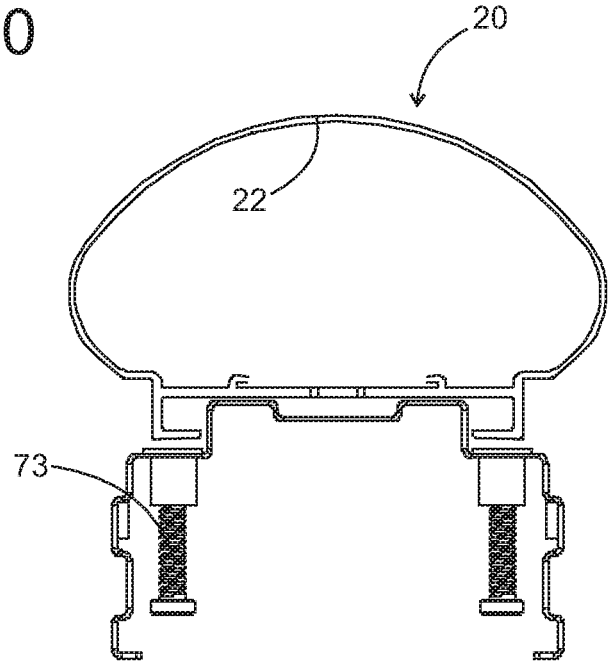
FIG. 11 is a cross-section view of the lamp body bracket with the connection adapter reversed.

As seen in FIGS. 10-11, the connection adapter 70 can be turned upside down and installed in an inverted position when the lamp body bracket 35 has sidewall irregularities that the lower sidewall channel 84, or the upper sidewall channel 85 can engage or latch to.

The invention claimed is:

1. A strip light has a:

a. a light module having a lens that has a light permeable portion, wherein the light module is elongated;

b. a mounting frame that includes a lamp body bracket receiving the light module, wherein the lamp body bracket is elongated and has a front mounting frame panel, a rear mounting frame panel, a right mounting frame panel, and a left mounting frame panel extending from a lamp body bracket base panel of the lamp body bracket;

c. a first rotating shaft lock mounted to the lamp body bracket base panel with a first axis of rotation;

d. a second rotating shaft lock mounted to the lamp body bracket base panel with a second axis of rotation, wherein the light module is secured to the lamp body bracket by a pair of rotating locks, including the first rotating shaft lock and the second rotating shaft lock;

e. an LED light board, wherein the LED light board has LED chips mounted to the LED light board;

f. a hook groove system mounted underneath the LED light board, wherein the hook groove system includes a first groove and a second groove; and g. a first tab extension mounted on the first rotating shaft lock, wherein the first tab extension rotates to engage the first groove; and a second tab extension mounted on the first rotating shaft lock, wherein the second tab extension rotates to engage the second groove.

2. The strip light of claim 1, wherein the lens has an opaque portion next to the light permeable portion.

3. The strip light of claim 1, further including a connection adapter, wherein the connection adapter has a connection adapter first side and a connection adapter second side, wherein the connection adapter adapts to the lamp body bracket at a first end of the lamp body bracket, or at a second end of the lamp body bracket.

4. The strip light of claim 3, wherein the connection adapter has two pairs of vertical bolts, namely a pair of first side vertical bolts, and a pair of second side vertical bolts, wherein the two pairs of vertical bolts extend through the connection adapter.

5. The strip light of claim 3, wherein the connection adapter has two pairs of side set screws, wherein the two pairs of side set screws are mounted in the connection adapter first side.

6. The strip light of claim 3, further including an adapter first flange and an adapter second flange, wherein the adapter first flange extends from the connection adapter first side, and wherein the adapter second flange extends from the connection adapter second side.

7. The strip light of claim 6, further including a front overhang formed on the front mounting frame panel and a rear overhang formed on the rear mounting frame panel, wherein the first adapter flange engages the front overhang and the adapter second flange engages the rear overhang when the two pairs of vertical bolts are engaged.

8. The strip light of claim 1, wherein the first rotating shaft lock has a first lever handle and the second rotating shaft lock has a second lever handle, wherein the first lever handle extends from a first shaft lock slot, and wherein the second lever handle extends from a second shaft lock slot, wherein the first shaft lock slot is located to the right of the second shaft lock slot, wherein the second shaft lock slot is located to the left of the first shaft lock slot, wherein the first shaft lock slot is a right shaft lock slot, and wherein the second shaft lock slot is a left shaft lock slot.

9. The strip light of claim 8, wherein the first rotating shaft lock is mounted to a first rotating flange joint, and wherein the second rotating shaft lock is mounted to a second rotating flange joint.

10. The strip light of claim 9, wherein the lens has an opaque portion next to the light permeable portion.

11. The strip light of claim 9, further including a connection adapter, wherein the connection adapter has a connection adapter first side and a connection adapter second side, wherein the connection adapter adapts to the lamp body bracket at a first end of the lamp body bracket, or at a second end of the lamp body bracket.

12. The strip light of claim 11, wherein the connection adapter has two pairs of vertical bolts, namely a pair of first side vertical bolts, and a pair of second side vertical bolts, wherein the two pairs of vertical bolts extend through the connection adapter.

13. The strip light of claim 12, wherein the connection adapter has two pairs of side set screws, wherein the two pairs of side set screws are mounted in the connection adapter first side.

14. The strip light of claim 13, further including an adapter first flange and an adapter second flange, wherein the adapter first flange extends from the connection adapter first side, and wherein the adapter second flange extends from the connection adapter second side.

15. The strip light of claim 14, further including a front overhang formed on the front mounting frame panel and a rear overhang formed on the rear mounting frame panel, wherein the first adapter flange engages the front overhang and the adapter second flange engages the rear overhang when the two pairs of vertical bolts are engaged.

* * * * *